US009028132B2

(12) United States Patent
Ungerechts et al.

(10) Patent No.: US 9,028,132 B2
(45) Date of Patent: May 12, 2015

(54) MIXING SILO

(75) Inventors: Herbert Ungerechts, Kerken (DE); Hans-Jörg Frank, Tönisvorst (DE); Christoph Schwemler, Leichlingen (DE); Reiner Horl, Kempen (DE); Hans-Jürgen Thiem, Dormagen (DE); Markus Hagedorn, Mülheim/Ruhr (DE)

(73) Assignee: Bayer MaterialScience AG, Leverkusen (DE)

( * ) Notice: Subject to any disclaimer, the term of this patent is extended or adjusted under 35 U.S.C. 154(b) by 0 days.

(21) Appl. No.: 13/415,327

(22) Filed: Mar. 8, 2012

(65) Prior Publication Data

US 2012/0230146 A1 Sep. 13, 2012

(30) Foreign Application Priority Data

Mar. 11, 2011 (EP) ..... 11157931
Nov. 24, 2011 (EP) ..... 11190632

(51) Int. Cl.

| | |
|---|---|
| ***B01F 15/02*** | (2006.01) |
| ***B01F 5/24*** | (2006.01) |
| ***B01F 15/00*** | (2006.01) |
| ***B08B 9/093*** | (2006.01) |
| ***B08B 9/08*** | (2006.01) |

(Continued)

(52) U.S. Cl.

CPC ..... *B01F 5/244* (2013.01); *B01F 15/00032* (2013.01); *B01F 15/0201* (2013.01); *B08B 9/093* (2013.01); *B08B 9/0813* (2013.01); *B65D 88/32* (2013.01); *B65D 90/0093* (2013.01)

(58) Field of Classification Search

CPC ..... B01F 5/244
USPC ..... 366/9, 181.1, 181.2, 181.5, 183.1
See application file for complete search history.

(56) References Cited

U.S. PATENT DOCUMENTS 298,904 A * 5/1884 Sheppard ..... 366/179.1
829,127 A * 8/1906 Strauss ..... 366/9
2,138,172 A * 11/1938 Johnson ..... 366/8

(Continued)

FOREIGN PATENT DOCUMENTS

DE 12 98 511 B 7/1969
DE 21 58 579 A1 5/1973

(Continued)

OTHER PUBLICATIONS

Equistar, Handling and Storage of Equistar Polymers, Retrieved Nov. 27, 2009, Lyondell Chemical Company, pp. 3-12.*

(Continued)

*Primary Examiner* — David Sorkin
*Assistant Examiner* — Abbas Rashid
(74) *Attorney, Agent, or Firm* — Drinker Biddle & Reath LLP

(57) ABSTRACT

A mixing silo for free-flowing finely divided solid materials, in particular for powdered, fibrous and/or granular mixed material, especially polymer granules, specifically suited for mixing polymer granules, having an excellent mixing quality and at the same time a simplified and improved suitability for washing out in order to avoid cross contamination. The mixing silo may be used for homogenizing possibly inhomogeneous polymer granule batches in the form of a stream of product from a process producing polymer granules.

11 Claims, 3 Drawing Sheets

(51) Int. Cl.

| | |
|---|---|
| *B65D 88/32* | (2006.01) |
| *B65D 90/00* | (2006.01) |

(56) References Cited

U.S. PATENT DOCUMENTS

| | | | | | |
|---|---|---|---|---|---|
| 2,455,572 | A | * | 12/1948 | Evans | 366/336 |
| 3,216,629 | A | * | 11/1965 | Goins | 222/459 |
| 3,275,303 | A | * | 9/1966 | Goins | 366/137 |
| 3,350,995 | A | * | 11/1967 | Jeru | 454/173 |
| 3,423,076 | A | | 1/1969 | Jacobs et al. | |
| 3,804,303 | A | * | 4/1974 | Fassauer | 406/71 |
| 3,822,056 | A | * | 7/1974 | Hawes et al. | 366/114 |
| 3,860,129 | A | * | 1/1975 | Bieth et al. | 366/153.2 |
| 4,285,602 | A | * | 8/1981 | Hagerty et al. | 366/181.6 |
| 4,358,207 | A | * | 11/1982 | Roth | 366/336 |
| 4,360,044 | A | * | 11/1982 | Wisneski | 141/9 |
| 4,412,748 | A | | 11/1983 | Wohnhas et al. | |
| 4,756,624 | A | * | 7/1988 | Hoppe et al. | 366/101 |
| 4,834,544 | A | * | 5/1989 | Paul | 366/101 |
| 4,854,722 | A | * | 8/1989 | Jackson | 366/341 |
| 4,978,228 | A | * | 12/1990 | Wilms | 366/138 |
| 5,018,869 | A | * | 5/1991 | Paul | 366/101 |
| 5,123,749 | A | * | 6/1992 | Avery, Jr. | 366/341 |
| 5,248,197 | A | | 9/1993 | Storf et al. | |
| 6,612,731 | B2 | * | 9/2003 | Nishida et al. | 366/173.2 |
| 7,077,906 | B2 | * | 7/2006 | Colombo et al. | 118/303 |
| 2003/0235111 | A1 | * | 12/2003 | Bishop et al. | 366/341 |

FOREIGN PATENT DOCUMENTS

| | | | |
|---|---|---|---|
| DE | 22 19 397 | A1 | 10/1973 |
| DE | 30 29 393 | A1 | 3/1982 |
| DE | 4040553 | A1 | 6/1992 |
| DE | 41 12 884 | A1 | 10/1992 |
| DE | 102005030514 | A1 | 1/2007 |
| EP | 60 046 | A1 | 9/1982 |
| EP | 0104863 | A2 | 4/1984 |
| GB | 1390750 | A | 4/1975 |
| JP | 51046753 | U | 4/1976 |
| JP | 51150156 | A | 12/1976 |
| JP | 56 111028 | A | 9/1981 |
| JP | 59053836 | | 4/1984 |
| WO | WO-99/55772 | A1 | 11/1999 |

OTHER PUBLICATIONS

Kiesgen, et al., "Zentralrohr-Mischsilo verbessert die Homogenität von Kunststoffen", vol. 81, No. 12, (1991), pp. 1100-1104.

* cited by examiner

MIXING SILO

PRIORITY

Priority is claimed to European Patent Application No. 11 157 931.4, filed Mar. 11, 2011, and to European Patent Application No. 11 190 632.7, filed Nov. 24, 2011, the disclosures of which is incorporated herein by reference in their entirety.

BACKGROUND OF THE INVENTION

1. Field of the Invention

The field of the present invention is mixing silos for free-flowing finely divided solid materials, in particular for powdered, fibrous and/or granular mixed material, especially polymer granules, specifically suited for mixing polymer granules, particularly, mixing silos for homogenizing possibly inhomogeneous polymer granule batches in the form of a stream of product from a process producing polymer granules.

2. Background

In mixing operations of mixing silos, additional finely abraded material should be avoided as far as possible, and there should be no foreign contamination by remains of granules from previous mixing and filling processes of other types of granules in the silo.

The granular product occurring in the reactor during the production of thermoplastics is plasticated in an extruder and formed in a granulating die into individual strands, which are cut into granules by means of a knife rotating in the granulating die. This product may be provided with further components in a further step by compounding.

Compounding is the term used in polymer preparation for producing the finished moulding compound from the raw plastics materials with the addition of fillers, reinforcing agents, plasticizers, coupling agents, lubricants, stabilizers, etc. The compounding is mainly performed in extruders and comprises the process operations of conveying, melting, dispersing, mixing, degassing and building up pressure.

During the granulation, the melt is then forced through the orifices of a die plate, so that subsequently, in the case of strand granulation, initially melt strands are produced, and then during the granulation these strands are turned into cylindrical granules, or else, in the case of die-face granulation, the strands are cut off directly as they emerge at the die plate and are turned into lenticular or spherical granules. The granulation may be performed, for example, in a stream of liquid, which cools the granules and largely avoids agglomeration. The granules are subsequently dried and screened, in order to separate out agglomerates formed in spite of cooling.

Following the granulation after production or after compounding, the product is generally conveyed pneumatically to a mixing silo.

In the mixing silo, the granules are homogenized to balance out fluctuations in the production process, and are possibly subsequently transported pneumatically into the storage silos.

The mixing silos known from the prior art are generally operated as gravity mixers or circulating mixers. For both types there are numerous proposals in the prior art as to how to use suitable internals in the silo container to achieve a high mixing quality, that is to say good homogenization of different bulk materials that are usually introduced into the silo container one after the other, even after the bulk material has passed through only once, or—in the case of circulating mixers—to keep down the number of circulations, and consequently the mixing time.

Depending on the requirement and design, an acceptable mixing quality is accordingly already achieved upon discharge. DE 41 12 884 C2 gives in the background description a comprehensive overview of the prior art, which is based substantially on the installation of funnel-shaped internals in the conical region of the mixing silo.

A disadvantage of the subject matter of DE 41 12 884 C2, however, is that a separate, multi-chamber funnel has to be fitted in the bottom region of a silo container, which makes it much more complicated to produce and maintain the mixing silo, since such a construction is quite difficult to clean.

A different approach to a solution is taken by the so-called in-line mixers, where vertical pipes with intake openings internally in the silo pass granules to the outlet from various heights. For example, multi-pipe blenders are used, in which the tubular channels on the inner wall are arranged into the conical region and achieve a degree of mixing while the material is simply running out. A disadvantage is the design-related effort that is correspondingly required for cleaning with water to avoid contamination.

The aim of all the configurations is to achieve an acceptable mixing quality with the lowest installation and operating costs and the easiest cleaning.

If the prior art is analysed with a view to this, it discloses strengths and weaknesses which have been sufficiently well documented in the literature.

For example, DE 12 98 511 and EP 60 046 A1 each show a mixing silo, the interior space of which is subdivided by vertical sheet segments, extending radially from the container outer wall to the centre axis thereof, into a number of chambers, which, given a suitable position of the filling opening, fill one after the other in accordance with the overflow principle as a result of correspondingly staged upper edges of the sheet segments, whereby often a vertical pre-mixing—albeit dependent on the batch size—is achieved instead of the purely horizontal layering that otherwise occurs.

A disadvantage of DE 41 12 884 C2, DE 12 98 511 and EP 60 046 A1 is, however, that the inlet and outlet cross sections of the mixing cross are each formed approximately the same, and consequently only a limited mixing-through of the bulk material can take place, with at the same time poor cleaning possibilities to avoid cross contamination.

Furthermore, DE 22 19 397 already discloses a mixing silo designed as a circulating mixer, in which the central rising pipe is surrounded by a further, comparatively much shorter pipe, so that this further pipe defines with the central pipe a first annular space and with the silo container wall and the conical bottom thereof a second annular space. During the circulation or removal of the bulk material, different sinking rates of the bulk material are obtained in the two annular spaces, so that fractions of bulk material originating from levels at different heights are blended or mixed with one another in the outlet region. Also based on a similar principle is the gravity circulating mixer known from DE 30 29 393 A1, in which, however, the circulation is not performed by way of a central pipe but by way of a vertical rising pipe running outside the silo container.

DE 21 58 579 A1 discloses a device for the continuous mixing of granular solid materials, which construction, in particular due to the valves (separately adjustable metering device) within the silo as well as due to the partly filled hopper leads to cross contamination during process. Similar apparatuses are described in JP 56 111028 A and JP 59 053836 U in which the individual chambers can be closed off individually and according to the construction the apparatus does lead to cross contamination during operation.

These known mixing silos all have the disadvantage that the internals provided in the silo container are subjected to considerable static and dynamic loads. Although the known mixing silos are designed without exception for mass flow conditions, there are also deposits of bulk material, which make it much more difficult for the silo container to be washed out. The requirement for the silo container to be suitable for washing out easily before filling with another type of bulk material is however being demanded increasingly frequently.

SUMMARY OF THE INVENTION

A mixing silo is provided with the aid of which largely homogeneous mixtures of polymer granules that occur in the form of a possibly inhomogeneous stream of polymer granule product can be produced. In addition, the mixing operation in such a silo should to the greatest extent possible avoid the production of extremely fine particles, brought about by the mixing operation itself, such as for example abraded material or fragments of granules.

Further, after completion of the emptying operation, the silo is preferably largely free from residual amounts of the granules previously conveyed therein.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
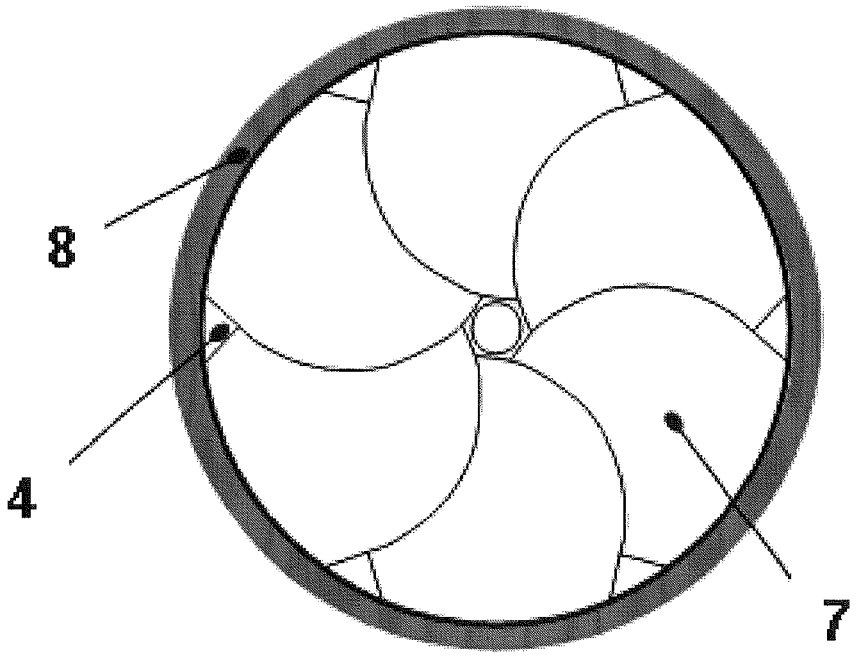
FIG. 1 is a silo cross section and shows the plan view from above of a mixing silo with the subdivisions into individual chambers, according to the invention.

A cylindrical vertically standing mixing silo is provided which includes a cylindrical container with a conical outlet and preferably having the following features:

i. a plurality of vertically arranged partition walls connect a central middle pipe, running in the direction of the longitudinal axis of the cylinder, and the silo wall to one another, so as to produce a number of chambers separated from one another, which can each be filled with granules from above and respectively have at the lower conical end of the silo an emptying opening for the removal of the granules, to be precise in such a way that all the emptying openings of the individual silo chambers open out into the cone of the silo and which optionally cannot be closed off;

ii. a device with the possibility of distributing the granules introduced into the silo into all the cylinder chambers of the silo in any way desired; and possibly iii. one or more devices, which may possibly allow itself/themselves to be positioned in a flexible or automated telescopic manner, but is/are preferably arranged fixed in place, for flushing all the regions of the interior space of the silo with liquid to remove remains of product from the silo.

iv. a silo design that is free from dead space, particularly concerning the silo internals and all the stubs, cones and flanges.

By contrast with mixing silos known from the prior art, such a mixing silo makes it possible to avoid to the greatest extent the production of extremely fine particles, along with equally good or even improved homogenization. Furthermore, the use of a device for flushing the mixing silo makes it possible to clean the latter easily and reliably of any remains of granules and dust possibly still present in the silo, so that contamination with following portions of granules can be ruled out with certainty.

The mixing silo can be used both for the homogenization of granules, the divergence of which for example through the stream of polymer granule product is caused because of tiny fluctuations in the upstream process, and for the homogenization of different product granules (e.g. blends).

Preferred as polymer granules are polycarbonate granules from a homopolycarbonate or a copolycarbonate, in pure form or as a mixture with further components. The polycarbonates may contain as additional components customary additives, such as for example mould release agents, flow promoters, heat stabilizers, UV and/or IR absorbers, flame retardants, pigments and fillers, and also other polymers.

The additional substances customary for these thermoplastics, such as fillers, UV stabilizers, IR stabilizers, heat stabilizers, antistatic agents and pigments, colourants, may also be added in the usual quantities to the polycarbonate granules; the demoulding behaviour, the flow behaviour, and/or the flame resistance may also be improved by the addition of external mould release agents, flow agents, and/or flame retardants (for example alkyl and aryl phosphites, phosphates, phosphanes, low-molecular-weight carboxylates, halide compounds, salts, chalk, silica flour, glass and carbon fibres, pigments and combinations thereof. Such compounds are described, for example, in WO 99/55772, pp. 15-25, and in "Plastics Additives", R. Gachter and H. Müller Hanser Publishers 1983).

The mixing silo has at least 2 chambers, but preferably more than 2 chambers, with particular preference 6 chambers. These chambers may be of different sizes, but should preferably be the same size and also have the same overall height in the mixing silo. The chambers are open over the entire cross section respectively at their upper and lower ends within the silo. The lower ends of the chambers are respectively adapted to the structural form of the conically narrowing silo, and may possibly be capable of being closed off individually. In the lowermost tip of the conical silo, into which all the chambers open out, there is created a mixing space (1), in which the homogenized mixture of polymer granules is obtained as a result of the simultaneous flowing together of all the partial streams from all the filled chambers and is transported from there to other storing or filling devices. The mixing space (1) can be shut off from the granule removal line (2) by a valve (3), so that defined amounts of granules can be built up in the silo. The partition walls, which form the silo chambers and run from the central middle pipe to the silo inner wall, may be of a straight or curved form; curved partition walls are preferred, as represented for example in FIG. 1. The partition walls are in this case formed such that no acute angles are created between adjacent chamber walls, in order that deposits of polymer granules can be avoided in these regions. Such acute angles between adjacent chamber walls can be avoided by providing additional segments (4), as represented in FIG.

1. In the entire granule-carrying inner region of the silo, the formation of so-called undercuts or gaps or joints of any kind is possibly deliberately avoided by structural measures, in order to eliminate the possibility of remains of granules being deposited at these points (design free from dead space). This applies in particular to the connecting flange (1*a*) of the removable silo outlet cone (mixing space 1). In this way it is ensured that, when handling following portions of granules of a different kind in this mixing silo, contamination with remains of products from previous portions of granules that were mixed in this mixing silo is avoided with certainty. In a preferred embodiment, the risk of such cross contamination is additionally prevented by flushing operations, for example with water, with preference with fully demineralized water, after completion of the operation of emptying the mixing silo. Apart from water, other liquids may be used, individually or as a mixture. The mixing silo is produced from materials which have a sufficiently smooth surface and do not permit contamination of the polymer granules to be treated with foreign substances, such as for example due to abrasion. Suitable materials for this are, for example, plastic, aluminium alloys or steel; aluminium alloys and steel are used with preference; particularly preferred are the steel grades 1.4301, 1.4541 and 1.4571.

In a preferred embodiment, the emptying openings of the individual silo chambers open out into the cone of the silo and are not closeable.

In a further preferred embodiment, the mixing space (1) below the silo chambers to the shut-off valve (3) has a volume of at most 2%, preferably at most 1%, particularly preferably at most 0.5% and at least 0.1%, preferably at least 0.2% of the total volume of the silo. The total volume of the mixing silo in this context is the addition of the volume of all chambers (7) and of the volume of the mixing space (1).

The homogenization of possibly inhomogeneous amounts of polymer granules, for example from a continuously operating granule production process, is performed by filling the silo chambers with the granules and subsequently letting out the granules. This takes place in such a way that the stream of granules (5) entering the silo is introduced into individual chambers (7) of the mixing silo (8) in defined amounts by way of a movable granule feeding device, such as for example a rotary tube distributor (6). At the same time, in the case of granules that are inhomogeneous as a result of fluctuations in the production process, it is important for the success of the homogenization that a sufficiently great number of chambers in the mixing silo are filled, and that the amounts of granules respectively filled into the chambers are not less than a lower minimum amount per chamber filling cycle. The filling cycle means here the time interval between the beginning and the completion of the filling of a chamber with granules before changing to the next chamber. In an extreme case where the amount is less than such a minimal amount per filling cycle, such as for example in the case of a constant rotation of the rotary tube distributor over all the chambers, it is possible for there to be inadequate separation of the entire amount of polymer granules awaiting homogenization into sufficiently large and possibly different partial amounts of granules. The desired amount of homogenization is brought about by first piling up sufficiently large amounts of granules with sufficiently different properties in a number of different chambers of the mixing silo, then by emptying the silo by the simultaneous and continuous outflow of the granules from all the chambers of the mixing silo and continuous mixing-through of all these partial streams in the cone of the mixing silo.

Irrespective of the total number of chambers in the mixing silo, at least 2 however, the number of chambers to be filled is dependent on the size of the portion of polymer granules to be homogenized and the size of the mixing silo. At least 2 chambers should be filled with preferably the same amount of granules (in terms of volume or mass), in order to ensure approximately the same amounts of granules flowing out at the lower ends of the chambers into the mixing space of the silo. If residual amounts of granules were left behind in one or more chambers due to unsuitable filling of the silo chambers, and these residual amounts could not be mixed at least with a further partial stream from one of the silo chambers, the mixing quality of the portion as a whole would be impaired. If there are more than 2 chambers in the mixing silo, preferably more than 2 mixing chambers of the mixing silo are filled, in particular 6 chambers of the same size are each filled to virtually the same filling level, as long as the size ratio of the mixing silo to the portion of polymer granules allows. For reasons of statics, respectively opposite silo chambers are preferably filled.

In a preferred embodiment, the filling of the silos is performed in the following way: the silos each stand on 4 weighing cells, which have been inserted into weighing modules as a supporting frame. This provides continuous recording of the weight of the silos. With the weight data, the product feeding amounts can be controlled, i.e. the pneumatic conveyances are switched on or off and the rotary tube distributor is brought into the suitable filling position.

Figure 2:
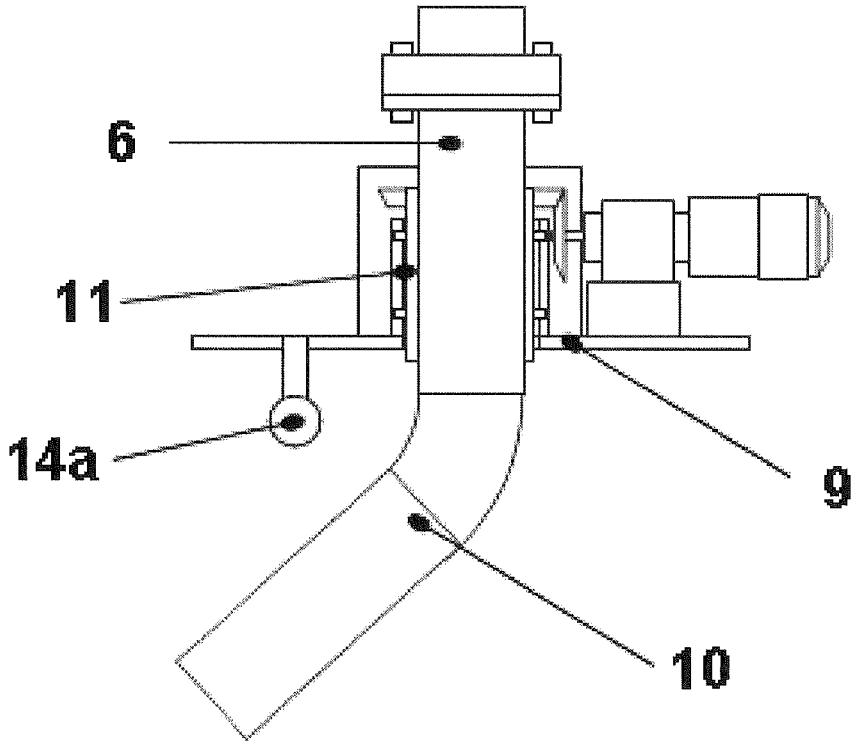
FIG. 2 shows a rotary tube distributor as an example of a device capable of distributing the granules introduced into a silo into all the cylinder chambers of the silo in any way desired.

In a further preferred embodiment, the filling of the upwardly open silo chambers takes place through a granule distributor, which can distribute the stream of granules, preferably introduced centrally at the silo roof, specifically among individual silo chambers in any desired way. Particularly suitable for this purpose is a granule distributor tube, as represented in FIG. 2 and referred to hereafter as the "rotary tube distributor". This rotary tube distributor is provided centrally on the roof of the silo (9) and consists of a rotatable tube (10) of a suitable length and suitable curvature, which can reach each silo chamber with the outlet device. The tube is preferably rotatably mounted in a holder (11) on the imaginary longitudinal axis of the cylindrical silo in the middle of the roof and, for changing or setting the filling position, can be turned, for example by a motor; this in turn can be controlled by suitable operating devices. The filling positions may be signalled by corresponding initiators at the silo chambers. The rotary tube is connected in a sealed manner to the granule feed line (12) on the roof (13) of the silo by way of a suitable flange. The diameter of the rotary tube corresponds largely to that of the granule feed line. The entire construction, in particular in the region of the flange connection of the rotary tube, is free from undercuts or gaps in which residual amounts of granules could remain. Suitable materials for producing the rotary tube are steel or aluminium alloys; preferred materials are steel, in particular high-grade steel (1.4301; 1.4541, 1.4571).

The selection of the various positions of the chambers in the mixing silo by the rotary tube distributor takes place with preference by means of initiators known from the prior art, which are arranged for each chamber in the housing of the rotary tube. As soon after starting as the rotary tube reaches, with a switching lug, the initiator of the chamber to be selected, the drive is switched off. In the case of a 6-chamber mixing silo, the filling is performed with preference in the sequence of chambers 1, 4, 2, 5, 3 and 6 (opposite chambers).

The granule mixing process is a purely gravimetric process, dispensing with additional granule conveying processes, such as for example circulatory pumping or mixing-through by pressure surge turbulences. As a result, the additional formation of abraded granular material is avoided to the greatest extent.

Figure 3:
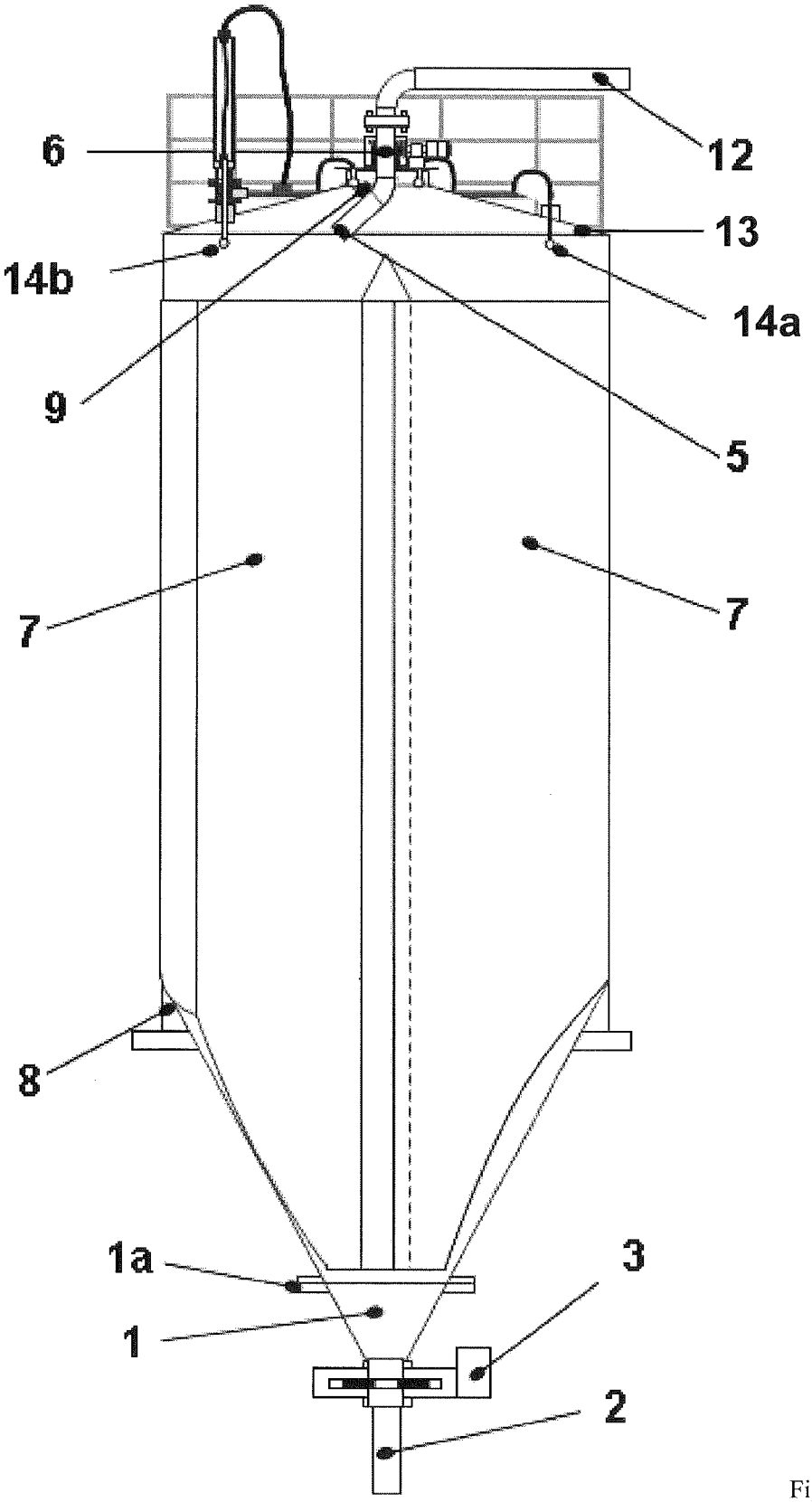
FIG. 3 shows a longitudinal section through a mixing silo with a sprayball according to the invention, which is located on the roof of the silo and can be positioned in a flexible manner.
Figure 4:
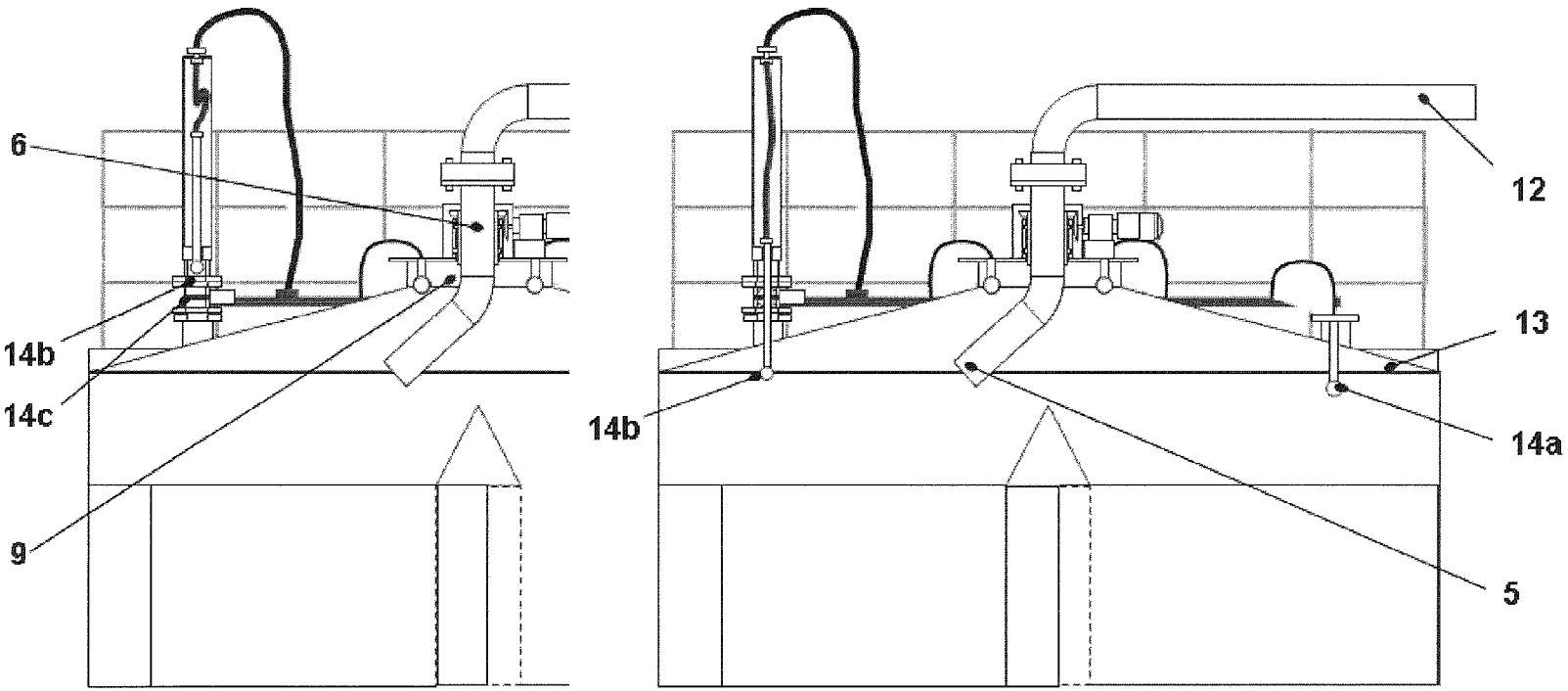
FIG. 4 shows the silo head with the flushing devices, in particular the two operating positions of the telescopic lance with a spray ball.

In a particularly preferred embodiment, the mixing silo includes as a further component part one or more devices for flushing all the regions of the interior space of the silo with water or some other liquid, to remove possibly still adhering remains of product from the silo, as represented in FIG. 3. This device is preferably installed on the silo roof (13) and formed such that with it all the chambers of the silo, the rotary tube distributor and the interior of the silo roof can be sprayed with water. This flushing device is preferably a spherical spray head (14*a*) with a multiplicity of water nozzles, so that parts of the plant can be flushed with water in a range of almost 360°. The water running off leaves the mixing silo through the shut-off valve (3) at the bottom of the mixing space (1) of the silo. The spray head may in this case be rigid or rotatable and may be seated on a fixed lance, which protrudes into the space to be flushed. FIG. 4 shows an alternative embodiment. Here, the spray ball (14*b*) is moved into the interior space by a driven telescopic lance for the flushing process. After the flushing process, the spray ball is retracted and is sealed off from the interior space, for example by way of a pivoting flap (14*c*), so that the spray ball is protected from product dust, which may possibly clog the water nozzles.

In a preferred embodiment, after the flushing process, the spray heads are flushed through and dried with compressed air. In the embodiment according to FIG. 4 (14*b*), it is possible to dispense with the flushing-through with compressed air. With preference, the spray heads consist of high-grade steel, 1.4404, but may also consist of other metal alloys.

In a preferred embodiment, the flushing process is an automated process with preferably 2 flushing phases. After the conveying process, the conveying diverter is adjusted such that the feed in the direction of the silo is blocked. Subsequently, the conveying line is flushed in the direction of the silo inlet. After completion of the first flushing process, the silo is flushed. For this purpose, water is applied to the spray balls above the individual chambers and the spray balls in the region of the silo roof (rotary tube distributor, manhole). After completion of the flushing, compressed air is blown through the spray balls and the latter are dried.

With preference, both flushing processes are monitored by a through-flow measurement. For successful flushing, the amounts of water flowing through should exceed a minimum limit value.

The interior spaces of the silo may possibly be dried by means of air. Alternatively, with preference, a so-called dripping time may be provided for the drying, a time in which the shut-off valve (3) remains open, so that residual moisture can run off.

Thus, a mixing silo is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A mixing silo comprising, a cylindrical container, having a container wall and a conical outlet;

a plurality of curved partition walls vertically arranged in the cylindrical container, connecting a central middle pipe, running in the direction of the longitudinal axis of the cylindrical container, and the container wall to one another, wherein the plurality of curved partition walls and the container wall of the cylindrical container form a plurality of chambers, separated from one another, the plurality of chambers being fillable with granules from above and each chamber having an emptying opening at the conical outlet for removal of the granules, and wherein all the emptying openings open out into the conical outlet and the emptying openings cannot be closed off; and a filling device configured to distribute the granules into each chamber.

2. The mixing silo according to claim 1, further comprising one or more devices configured to flush regions of interior space of the mixing silo with liquid to remove remains of product from the mixing silo.

3. The mixing silo according to claim 2, wherein the one or more devices for flushing are arranged fixed in place or in a flexible and telescopic manner.

4. The mixing silo according to claim 1, wherein the filling device is of the rotary tube distributor type, is disposed centrally on a roof of the silo, and comprises a rotatable tube, having a length and curvature suitable for the mixing silo.

5. The mixing silo according to claim 4, further comprising initiators configured to establish filling positions.

6. The mixing silo according to claim 1, wherein a mixing space formed from below the chambers to a shut-off valve has a volume of at most 2% and at least 0.1% of a total volume of the silo, wherein the total volume of the silo is the sum of volumes of all chambers the mixing space.

7. The mixing silo according to claim 6, wherein the mixing space volume is at most 1% and at least 0.2% of the total volume of the mixing silo.

8. Use of a mixing silo according to claim 1, characterized in that polymer granules are filled into the silo chambers and the polymer granules are subsequently let out.

9. Use of a mixing silo according to claim 8, characterized in that, after letting out the polymer granules, the chambers are flushed out.

10. The mixing silo according to claim 1, wherein the plurality of curved partition walls is formed without acute angles between adjacent chamber walls.

11. The mixing silo according to claim 1, further comprising segments positioned between each curved partition wall and the container wall to avoid the creation of acute angles between adjacent chamber walls.

* * * * *